US005134943A

United States Patent [19]

Cardinal

[11] Patent Number: 5,134,943

[45] Date of Patent: Aug. 4, 1992

[54] ANTI-JAMMING DEVICE FOR SECURITY SCREENS

[75] Inventor: Michael J. Cardinal, Victoria, Australia

[73] Assignee: Safetell International Security, Ltd., Victoria, Australia

[21] Appl. No.: 612,665

[22] Filed: Nov. 14, 1990

[30] Foreign Application Priority Data

Nov. 14, 1989 [AU] Australia ..... PJ7399

[51] Int. Cl.[5] ..... E06B 9/04

[52] U.S. Cl. ..... 109/17; 109/13; 109/21; 49/28

[58] Field of Search ..... 109/11-14, 109/17, 21, 38, 43; 49/28

[56] References Cited

U.S. PATENT DOCUMENTS 1,635,121 7/1927 Goodman ..... 109/21
2,007,744 7/1935 Cordray ..... 109/17
2,110,177 3/1938 Rohrig ..... 109/17
3,067,700 12/1962 O'Meara et al. ..... 109/12
4,831,939 5/1989 Cardinal ..... 109/17

FOREIGN PATENT DOCUMENTS 1420764 11/1965 France ..... 109/11
2192932 1/1988 United Kingdom ..... 109/11

*Primary Examiner*—Neill R. Wilson
*Attorney, Agent, or Firm*—Larson and Taylor

[57] ABSTRACT

An anti-jamming device for a security screen arrangement, in which a security screen is able to be rapidly fired from a rest position to an upper position at which passage of a person from one side of the screen to another is not possible, includes sensors for detecting whether the screen is at the rest position or the upper position. The device also includes a valve for lowering a screen when it does not reach the upper position, due to the screen having been jammed, and for reactivating the firing of the screen. The screen may be repeatedly fired until the obstruction is cleared.

6 Claims, 2 Drawing Sheets

ANTI-JAMMING DEVICE FOR SECURITY SCREENS

BACKGROUND OF THE INVENTION

1. Field of the Invention

This invention relates to security screens for use in banks, savings and loan premises, building society offices and the like, and in particular relates to an anti-jamming device for such screens.

2. Description of the Prior Art

U.S. Pat. Nos. 4,748,914 and 4,831,939 describe security screens o the indicated type. Such screens are adapted to rapidly ascend from counters when a robbery is detected, thus screening staff and currency from the robbers. There is a concern that such screens may jam, rendering them ineffective.

One existing approach to counteract security screen jamming is to use a collapsible bulkhead. In such an arrangement the bulkhead is constructed to collapse when a screen is jammed by having something placed over it.

Whilst this approach is effective, there are a number of disadvantages. Once the bulkhead has collapsed, a major rebuild must be undertaken before the premises are able to operate normally. Furthermore, the aesthetic design of the bulkhead is greatly limited. In addition, when an existing security screen system is upgraded, the cost of a collapsible bulkhead is prohibitive.

Finally, a collapsible section of at least the reach of the screen is required over and above the lower level of the bulkhead. This amount of room is rarely available.

Another prior manner of overcoming screen jamming consists of a flap covering the opening from which the screen emerges, the flap is hinged on the front edge. When the screen is activated the flap flips forward theoretically knocking away the jamming device if it falls within a length that will be hit by the flap. If it is too long the flap will fail to open, if it is too short the flap will miss completely.

BRIEF SUMMARY OF THE INVENTION

It is an object of this invention to provide an anti-jamming device for a security screen.

The invention provides an anti-jamming device for a security screen, including means for detecting a state in which a fired security screen is jammed, said state representing a failure to reach a predetermined height, means for lowering the screen when a jam is detected, and means for reactivating the firing of said security screen until said security screen reaches said predetermined height.

The invention also provides a security screen arrangement, in which a security screen is adapted to be rapidly propelled or fired from a rest position to a predetermined height above said rest position, an anti-jamming device including a 'screen-up' sensor adapted to detect the presence of at least part of said screen at said predetermined height, and a 'screen down' sensor adapted to detect the presence of a screen at or near said rest position, means to lower said screen from a position which is less than said predetermined height due to jamming of the screen, and means for reactivating the propulsion of said screen when said 'screen down' sensor detects that the screen is at or near said rest position, until said screen reaches said predetermined height.

DETAILED DESCRIPTION OF THE PREFERRED EMBODIMENT

Figure 1:
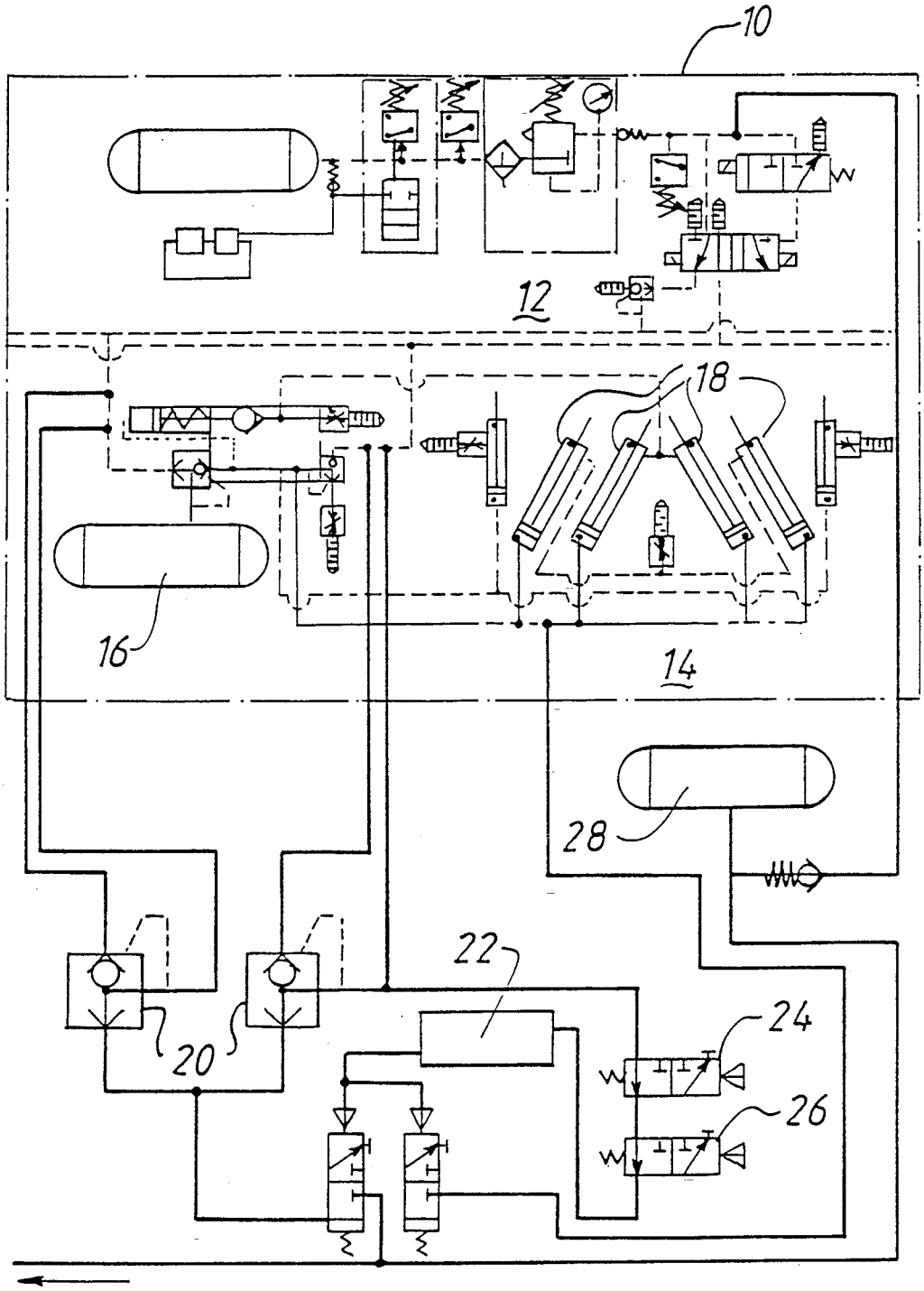
FIG. 1 is a schematic diagram of an embodiment of an anti-jamming device in accordance with the present invention.
Figure 2:
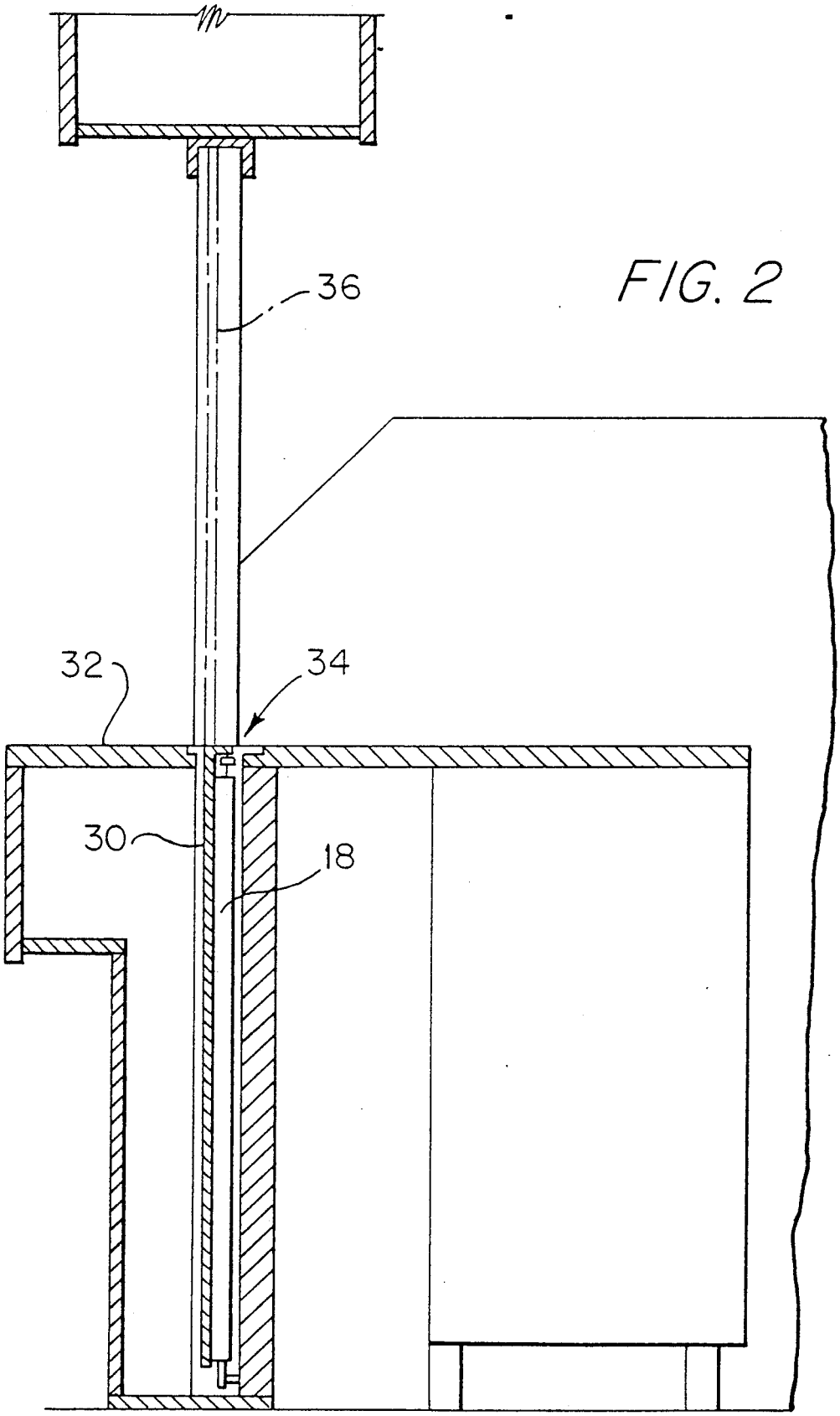
FIG. 2 is a sectional side elevation of a prior art security screen arrangement that can be controlled by the device of the invention.

The diagram of FIG. 1 is intended to be read in conjunction with the general disclosures of U.S. Pat. Nos. 4,748,914 and 4,831,939, which are incorporated into this specification by reference. FIG. 2 is substantially identical to FIG. 1 of U.S. Pat. No. 4,031,959.

The anti-jamming device of the embodiment of FIG. 1 involves features which will, in conjunction with the security screen arrangement of the aforementioned United States patens, provide anti-jamming operation of such an arrangement.

The features include:

1. A sensing device to detect that each security screen has reached a safe height which is preferably the 'fired' height less 200 mm.
2. A system to isolate the screen that has not reached its safe height, including
   (a) a timing device,
   (b) a flow detector on pneumatic rams used to fire the screen, and
   (c) a proximity switch,
3. A valve to quickly drop the isolated security screen.
4. A sensing device to reactivate the screen and the reset cycle, including
   (a) a timing device,
   (b) a proximity switch,
   (c) a micro switch.

The above can be achieved either electrically, pneumatically or with a combination of both.

One other consideration is the requirement for the provisional additional air storage (in a pneumatically-operated system) to ensure that the system can handle multi-part firings.

In FIG. 1, a prior art system of the type disclosed ion the aforementioned United States patents is shown enclosed by a rectangular border and marked 10. Some features of the prior art system are master components 12 and screen components 14, the latter including an air tank 16 and pneumatic rams 18.

Parts of the aforesaid prior art system or arrangement are shown in FIG. 2. A screen 30 is adapted to be propelled from a rest position, shown in solid lines, wherein the top of screen 30 is generally level with a bench 32, as shown by reference numeral 34.

Rams 18, one of which is shown in FIG. 2, drive or propel screen 30 from the rest position to a raised position, which is represented by broken lines and indicated by reference numeral 36.

The device of this embodiment of the invention includes a reserve air tank 28 (to allow for repeated screen firings), isolators 20, a timer 22, a 'screen down' sensor 24 and a 'screen up' sensor 26. The arrow at lower left indicates a pneumatic connection to other screens.

The device of FIG. 1 operates as follows.

When the screens are fired in accordance with the prior art disclosures, the device detects jamming—that is, the placement of an article or a person or part of a person between the top of the security screen and, for example, a bulkhead—by the failure, within a predetermined time, of sensor 26 to detect the presence of a screen at a predetermined height, and thus to send a 'screen up' signal. Preferably, such sensor 26 is located at such a position that a screen reaches within 200 mm of an upper bulkhead, it is considered to be up. The space of 200 mm is considered sufficient to prevent a person lying on the screen from suffering repeated blows as the screen is activated.

When jamming is so detected, isolators 20 isolate the screen from other non-jammed screens, lower the screen until sensor 24 detects that the screen is down by detecting its presence at a predetermined height, at which time the screen is reactivated.

It is considered that most jamming situations will be resolved by one such cycle, with any jamming device falling or being expelled when the screen is dropped or reactivated. Should this not occur, the cycle will continue. If the jamming device is supported in some way, the screen will continue to fire, rapidly, making it impossible for a person to attempt to jump over it. Of course, eventually the air supply will be exhausted, hence the desirability of having additional capacity (tank 28) but it is considered that by then robbers would have been sufficiently deterred to flee the premises.

I claim:

1. An anti-jamming device for a security screen, which is adapted to be propelled upwardly from a rest position, including means for detecting a state in which an activated security screen is jammed, said state representing a failure of said security screen to reach a predetermined height, means for lowering the screen when a jam is detected, and means for reactivating the propulsion of said security screen until said security screen reaches said predetermined height.

2. An anti-jamming device according to claim 1, further including means for isolating the jammed screen from other, non-jammed security screens.

3. An anti-jamming device according to claim 1, wherein a cycle of state detection, screen lowering and reactivation of the propulsion of said screen, is continued until said predetermined height is reached.

4. An anti-jamming device according to claim 3, wherein said security system is propelled by pneumatic means, and there is an additional source of air, said cycle operating until said predetermined height is reached or until the air from said source is exhausted.

5. In a security screen arrangement, in which a security screen is adapted to be rapidly propelled from a rest position to a predetermined height above said rest position, an anti-jamming device including a "screen-up" sensor for detecting the presence of at least part of said screen at said predetermined height, and a "screen down" sensor for detecting the presence of a screen at or near said rest position, means for lowering said screen from a height which is less than said predetermined height due to jamming of the screen, and means for reactivating the propulsion of said screen when said "screen down" sensor detects that the screen is at or near said rest position, until said screen reaches said predetermined height.

6. An anti-jamming device according to claim 5, further including timing means for providing a delay sufficient for said screen to reach, under normal circumstances, said predetermined height, each time the screen is activated to provide propulsion thereof.

* * * * *